US005303982A

United States Patent [19]

Johnston

[11] Patent Number: 5,303,982

[45] Date of Patent: Apr. 19, 1994

[54] USER-OPERATED SEAT UPLIFT APPARATUS

[76] Inventor: Gary L. Johnston, P.O. Box 183, Cowarts, Ala. 36321

[21] Appl. No.: 759,233

[22] Filed: Sep. 13, 1991

[51] Int. Cl.[5] ..... A47C 3/32

[52] U.S. Cl. ..... 297/339; 297/338; 297/DIG. 10; 297/411.3

[58] Field of Search ..... 297/339, 338, 337, 345, 297/346, 323, 417, DIG. 10, 347, 348; 4/560.1, 564.1, 565.1; 482/120, 126; 254/93 R

[56] References Cited

U.S. PATENT DOCUMENTS

| | | | |
|---|---|---|---|
| 459,282 | 9/1891 | Gollon | 482/96 |
| 2,788,527 | 4/1957 | Steven | 4/565.1 |
| 2,850,075 | 9/1958 | Wilson | 297/DIG. 10 X |
| 3,233,868 | 2/1966 | Harvey et al. | 254/93 R X |
| 4,034,426 | 7/1977 | Hardwick et al. | 4/564.1 |
| 4,888,833 | 12/1989 | Garcia et al. | 297/339 X |
| 4,907,303 | 3/1990 | Baird | 297/339 X |
| 4,929,022 | 5/1990 | Geraci | 297/339 X |

FOREIGN PATENT DOCUMENTS

| | | | |
|---|---|---|---|
| 1435559 | 5/1976 | United Kingdom | 297/DIG. 10 |
| 2183150 | 6/1987 | United Kingdom | 297/DIG. 10 |

*Primary Examiner*—James R. Brittain
*Attorney, Agent, or Firm*—Richard C. Litman

[57] ABSTRACT

A user-operated seat uplift apparatus including a structural frame unit and a mechanical uplift assembly unit, thereby allowing the user to more easily obtain a standing position from a previous seated position. The structure frame unit is used to support and guide the mechanical uplift assembly unit. The uplift unit consists basically of a seat member, two rail members, one disposed on each side of the seat member, and an interconnection means. The user presses downward upon the rail members, which move in a downward direction. This downward movement produces an upward movement in the seat member. And likewise, downward movement of the seat member results in upward motion of the rail members. This interface allows the user to more easily uplift themselves from a seated position and should prove especially useful for older and medically disabled persons.

30 Claims, 8 Drawing Sheets

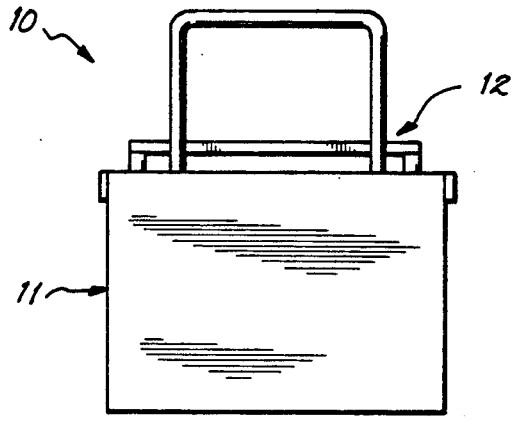
FIG. IA
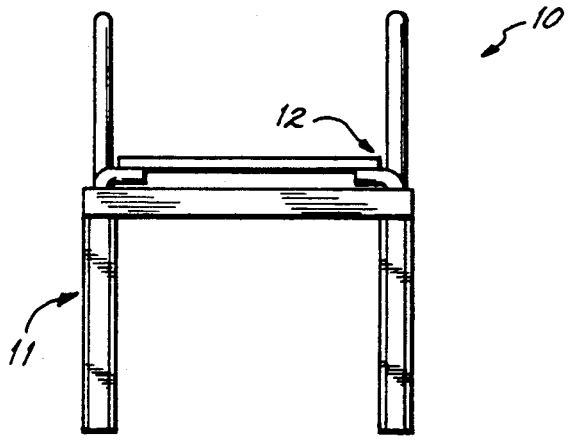
FIG. IB
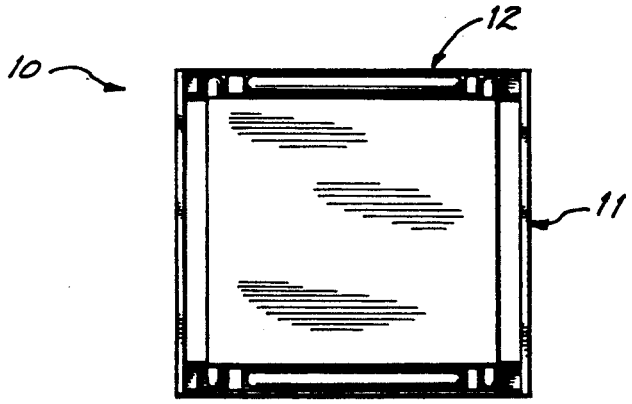
FIG. IC

USER-OPERATED SEAT UPLIFT APPARATUS

BACKGROUND OF THE INVENTION

This invention relates to a seat uplift apparatus and in particular to a sitting device from which the user may uplift themselves from a seated position to a point where a standing position may be more easily obtained. This is accomplished solely by the user whereas the user pushes downward upon a set of rails, producing downward motion in the rails. This downward motion creates upward motion in the seat element. This raised seat position allows the user to more easily achieve an upright, standing position.

As may be seen, there already exists sitting devices designed to assists the user in obtaining a standing position from a previous seated position. However, these sitting devices are relatively expensive, bulky and heavy in size, and difficult to move from place to place. Also, these devices use electrical power to uplift the user, therefore these devices must always be located close to electrical outlets. Given the fact that there are a good many persons, especially those elderly and medically disabled, who have difficulty uplifting themselves from a seated position, it comes as a surprise that no one has designed a seat uplift device which is user-operated purely through mechanical means. These devices could be designed for use on house, yard, car, and airline chairs, for use on toilets, for use on wheel chairs, and many other items.

SUMMARY AND OBJECTS OF THE INVENTION

It is an object of this invention to provide a user-operated seat uplift apparatus which may be easily operated through mechanical means. Included will be the various forms and uses the apparatus may adhere to.

It is a further object of this invention to provide standard sitting devices which utilizes the uplifting seat apparatus. These devices include a normal chair structure, a toilet structure, and a wheel chair structure.

Briefly stated, the user-operated seat uplift apparatus that forms the basis of the present invention comprises a structural frame unit and an mechanical uplift assembly unit.

The structural frame unit includes vertical and horizontal support members, side plates, structure pulleys, and guide elements for loosely receiving and supporting the mechanical uplift assembly unit.

The mechanical uplift assembly unit includes a seat member which supports and uplifts the user while in a seated position, rail members disposed on each side of the seat member from which the user operates the uplift feature, and an interconnection means for connecting seat member and rail members.

Other objects, features, and advantages for this invention will be apparent from the following detailed description and the appended claims, references being made to the accompanying drawings forming a part of the specification, wherein like reference numerals designate corresponding parts of the several views.

BRIEF DESCRIPTION OF THE DRAWINGS

FIG. 1A is a side view of the user-operated seat uplift apparatus while in a disengaged position.

FIG. 1B is a front view of the uplift apparatus while in a disengaged position.

FIG. 1C is a top view of the uplift apparatus while in a disengaged position.

DETAILED DESCRIPTION OF THE PREFERRED EMBODIMENT

Figure 2A:
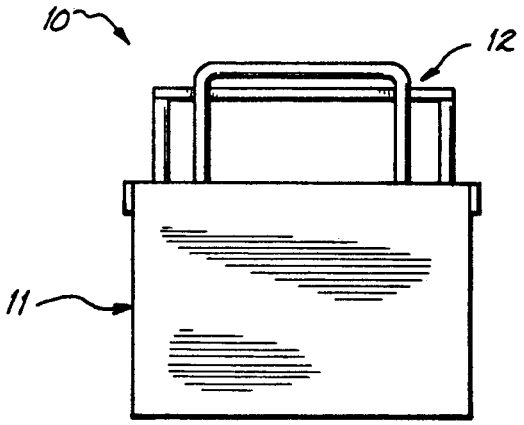
FIG. 2A is a side view of the user-operated seat uplift apparatus while in an engaged position.
Figure 2B:
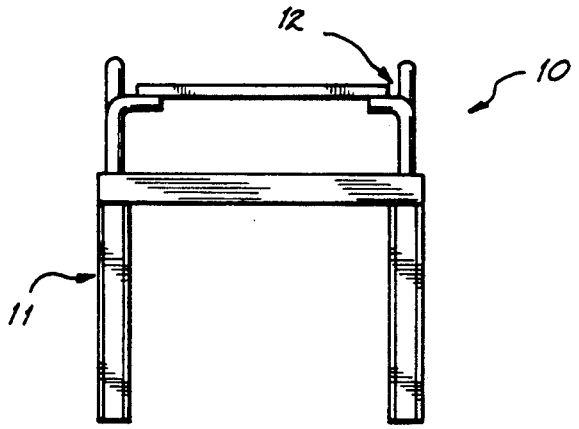
FIG. 2B is a front view of the uplift apparatus while in an engaged position.
Figure 2C:
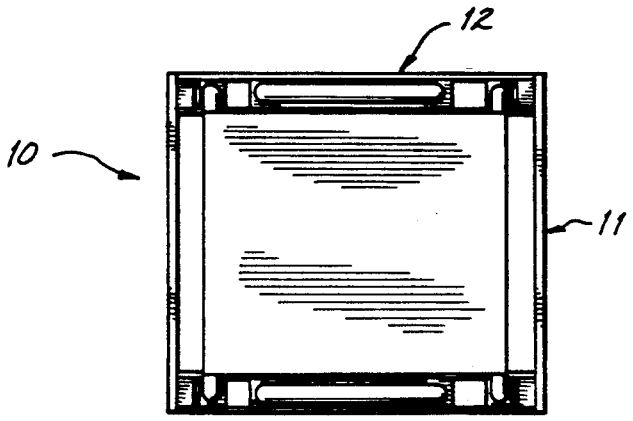
FIG. 2C is a top view of the uplift seat apparatus while in an engaged position.

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description, and not limitation.

As best can be seen by references to the drawings, and in particular to FIGS. 1A–2C, the user-operated seat uplift apparatus that forms the basis of the present invention is designated generally by the reference numeral 10. User-operated seat uplift apparatus 10 comprises a structural frame unit 11 and a mechanical uplift assembly unit 12.

Figure 3A:
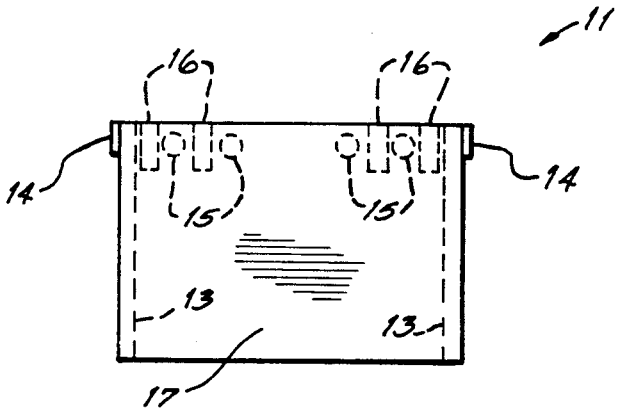
FIG. 3A is a side view of the structural frame unit.
Figure 3B:
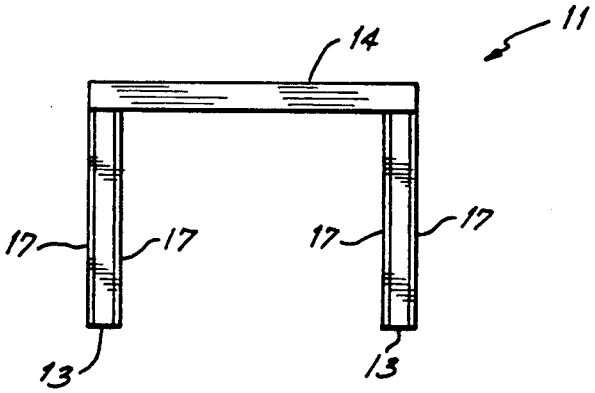
FIG. 3B is a front view of the structural frame unit.
Figure 3C:
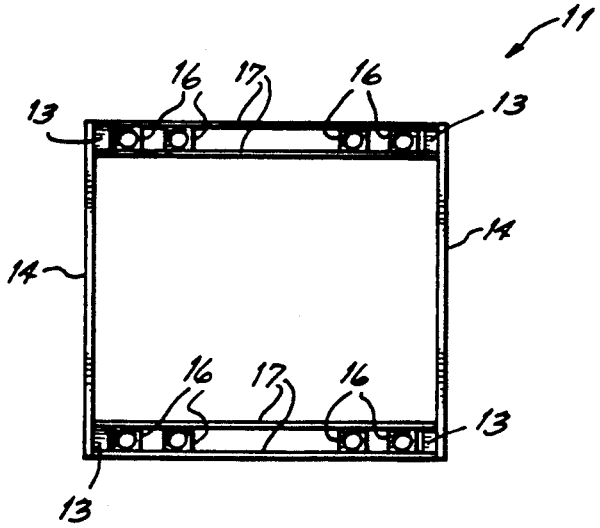
FIG. 3C is a top view of the structural frame unit.
Figure 4A:
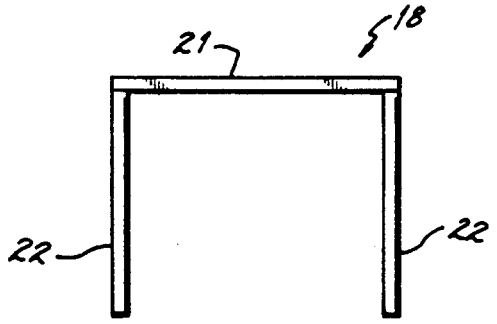
FIG. 4A is a side view of the seat support member.
Figure 4B:
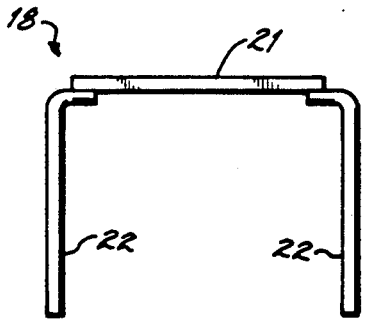
FIG. 4B is a front view of the seat support member.
Figure 4C:
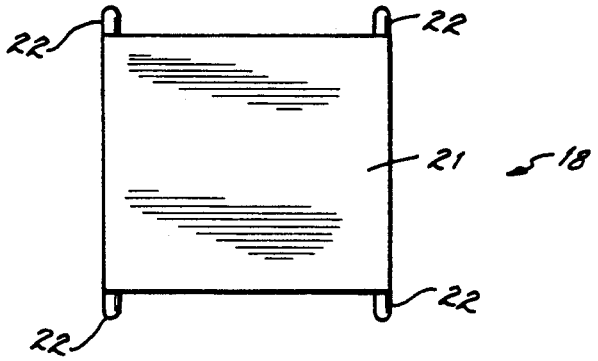
FIG. 4C is a top view of the seat support member.
Figure 5A:
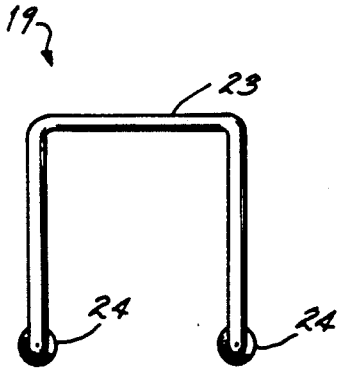
FIG. 5A is a side view of the rail member.
Figure 5B:
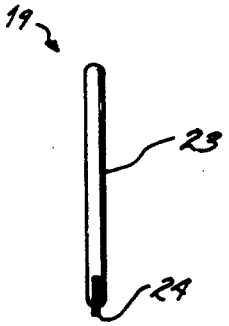
FIG. 5B is a front view of the rail member.
Figure 5C:
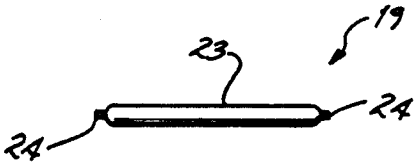
FIG. 5C is a top view of the rail member.

As shown in FIGS. 3A–3C, the structural frame unit 11 of the user-operated seat uplift apparatus comprises vertical support members 13 and horizontal support members 14 for structure support, structure pulleys 15 for supporting mechanical uplift assembly unit 12, guide elements 16 for guiding mechanical uplift assembly unit 12, and side plates elements 17 which attach to vertical support members 13 and support structure pulleys 15 and guide elements 16.

Figure 6A:
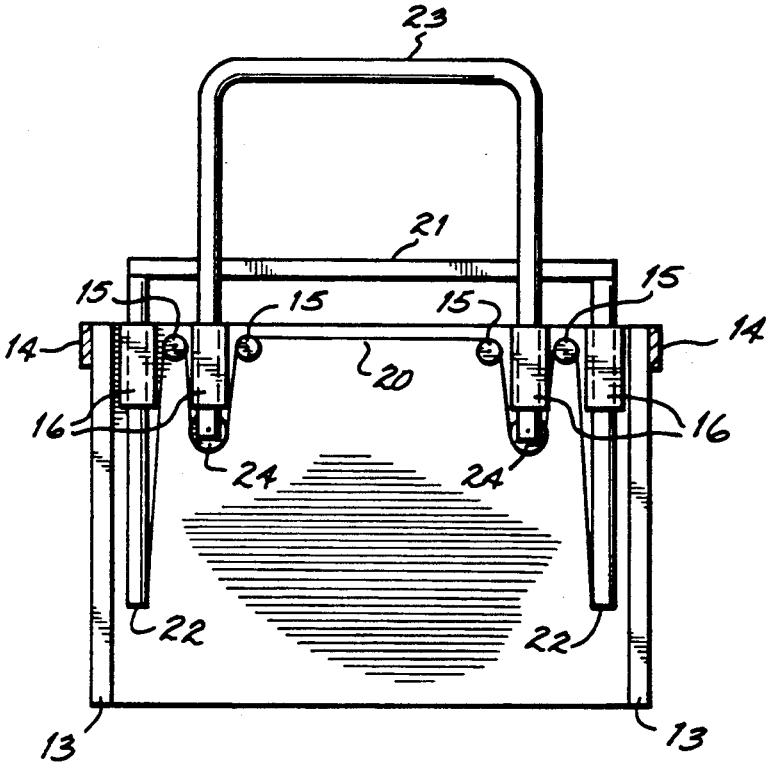
FIG. 6A is a side view of the mechanical uplift assembly unit while in a disengaged position.
Figure 6B:
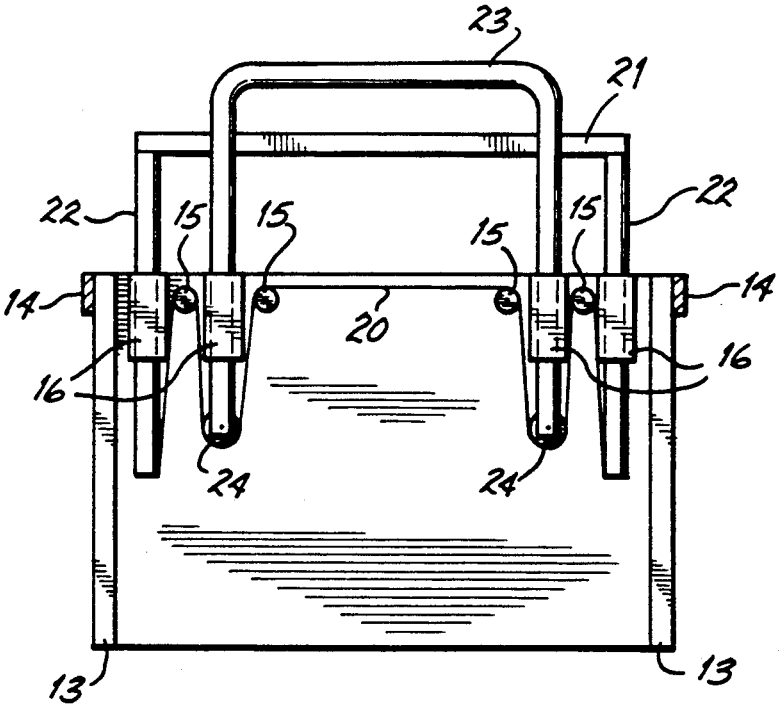
FIG. 6B is a side view of the mechanical uplift assembly unit while in an engaged position.

Referring to FIGS. 4A–6B, the mechanical uplift assembly unit consists of seat member 18, rail member 19, and cable element 20. Seat member 18 and rail member 19 both provide support to the user. Cable element 20 is used to interconnect seat member 18 and two rail members 19, one on each side of seat member 18. The seat member 18 consists of seat element 21 and vertical seat element supports 22, which are located at each corner of the seat element. Rail member 19 consist of rail element 23 which is a U-shaped structure containing rail pulleys 24 at each end. FIGS. 6A and 6B demonstrate how the assembly unit functions.

Figure 7A:
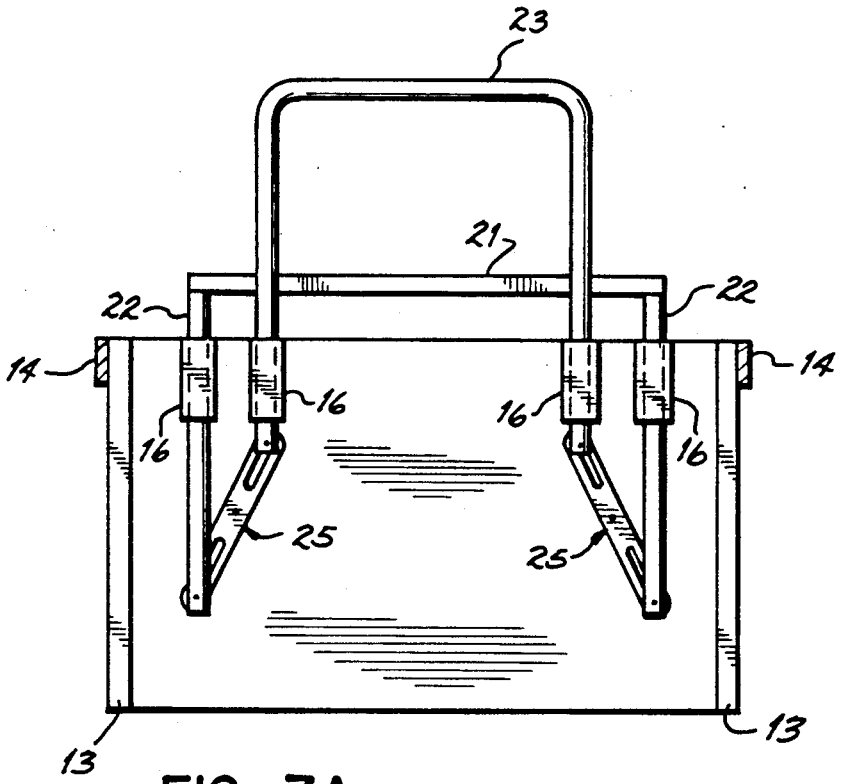
FIG. 7A is a side view of a second type of mechanical uplift assembly unit while in a disengaged position.
Figure 7B:
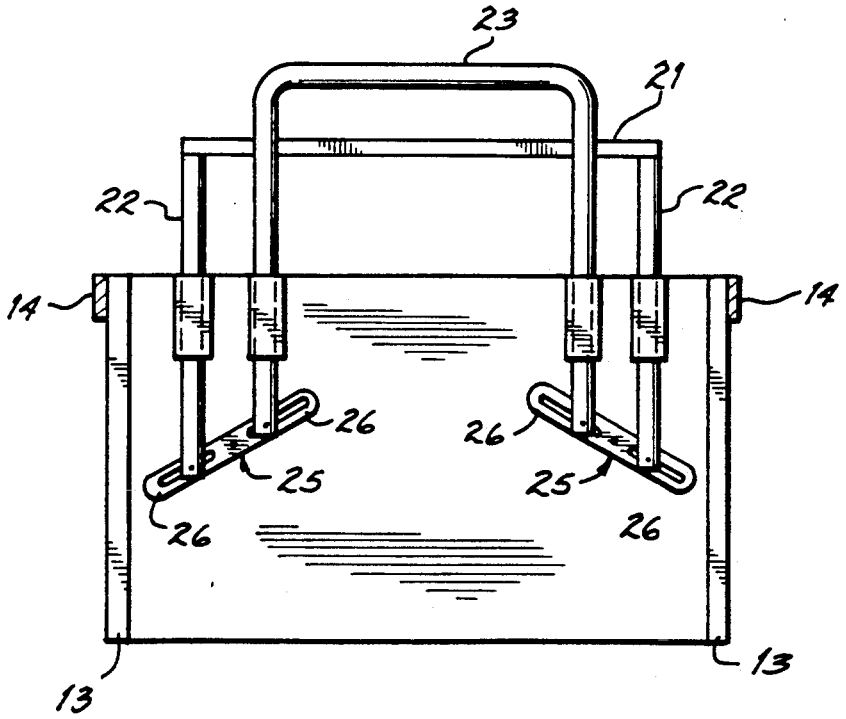
FIG. 7B is a side view of a second type of mechanical uplift assembly unit while in an engaged position.

FIGS. 7A and 7B demonstrate an alternative mechanical uplift assembly unit which utilizes a linkage system instead of the pulley and cable assembly stated above. Seat member 18 and rail member 19 are interconnected through linkage elements 25 instead of cable element 20.

Figure 8:
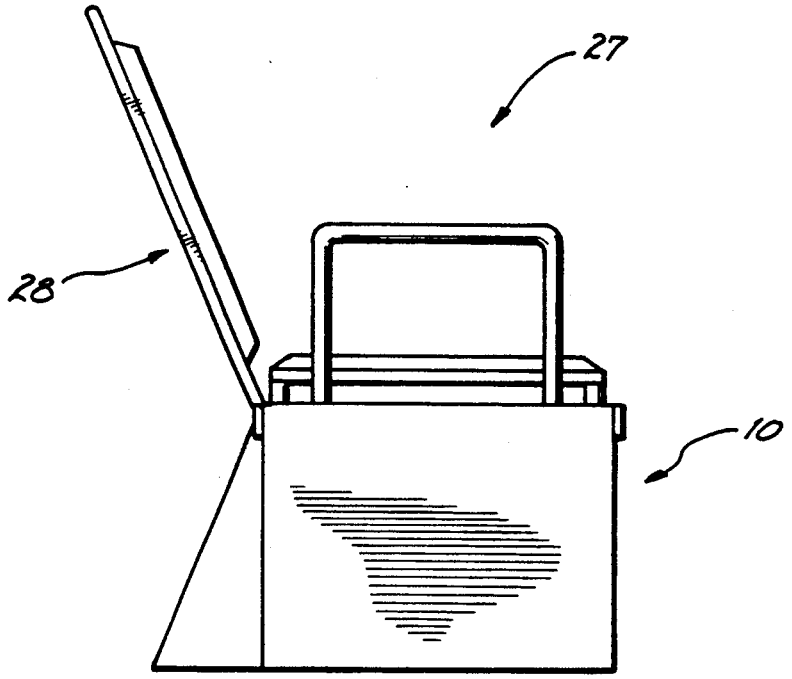
FIG. 8 is a side view of a chair structure incorporating the user-operated seat uplift apparatus.
Figure 9:
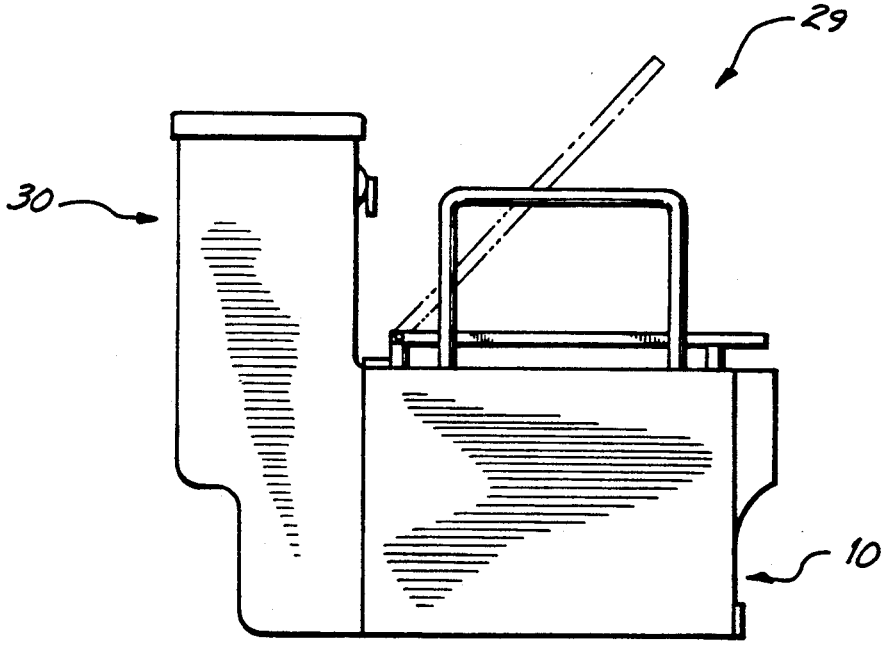
FIG. 9 is a side view of a toilet structure incorporating the user-operated seat uplift apparatus.
Figure 10:
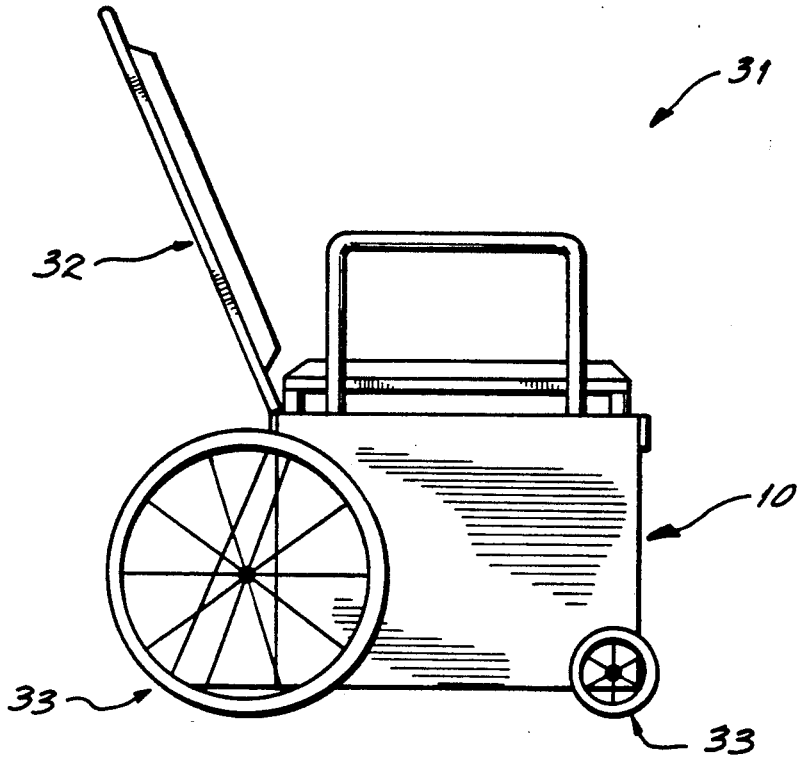
FIG. 10 is a side view of a typical wheel chair structure incorporating the user-operated seat uplift apparatus.

FIGS. 8, 9, and 10 demonstrate chair, toilet, and wheel chair apparatuses which utilize the user-operated seat uplift apparatus in allowing the user to more easily achieve a standing position.

As can be seen in FIGS. 1A–5C, user-operated seat uplift apparatus 10 is used to enable a person to more easily obtain a standing position from a previous seated position. This is accomplished by pressing downward upon rail members 19 which are located to the side of seat member 18. The resulting downward motion of rail members 19 will produce an upward motion in seat member 18. Also, downward motion in seat member 18 results in upward motion of rail members 19. Downward motion in seat member 18 may result from the user sitting back down or seat member 18 being heavier that rail members 19 and gravity causing the downward motion.

FIGS. 6A and 6B demonstrate the operation of user-operated seat uplift apparatus 10. These figures show the interaction between the frame structure unit 11 and the mechanical uplift assembly unit 12. Also shown is the interaction between the seat and rail members of the mechanical uplift assembly unit.

These figures show one side of the user-operated seat uplift apparatus, therefore only one side of seat member 18 and one rail member 19 is shown. As can be seen, vertical seat support elements 22 and rail element 23 slide upward and downward through the guide elements 16. As can be seen further, cable element 20 connects at one end to the bottom of one vertcal seat support element 22, then loops up and over the first of structure pulleys 15, then loops down and under first of rail element pulleys 24, then loops up and over the second of structure pulleys 15, then remains horizontal until it reaches the third of structure pulleys 15, where it loops over this third pulley and then loops downward to the underside of the second of rail element pulleys 24, then upward and over the fourth of structure pulleys 15, and then downward where the other end of the cable connects to the bottom of the second of vertical seat support elements 22.

As demonstrated, when rail element 23 is pushed downward, the cable will follow along rail element pulleys 24 and also move downward. This cable movement causes the vertical seat support elements 22 to move in an upward direction, thereby causing seat element 21 to move in an upward direction. As the pulley system is presently demonstrated, the distance seat member 18 travels upward will be twice the distance the rail member 19 travels downward. Different configurations may be used to produce different ratios of seat member travel distance to rail member travel distance.

As shown in FIGS. 7A and 7B, a second version of user-operated seat uplift apparatus 10 utilizes a linkage system instead of a pulley and cable system. The linkage elements 25 rotate about a fixed axis and contains elongated slots 26 at each end. Vertical seat support elements 22 and rail element 23 loosely attach to the linkage element through slots 26 by pin connection. Since the linkage elements 25 rotate about a fixed point, the slots 26 will then allow for upward and downward motion of seat support elements 22 and rail element 23. As shown, linkage elements 25 are symmetrical in design and seat support elements 22 and rail element 23 are connected at an equal distance from the linkage center of rotation. Therefore the ratio of the distance seat member 18 travels with respect to rail member 19 will be one. Ratios other than one may be obtained if the connection distances from the center of rotation are not equal.

FIGS. 8, 9, and 10 demonstrate the various uses of user-operated seat uplift apparatus 10. FIG. 8 shows a chair apparatus 27 consisting of back support member 28 and user-operated seat uplift apparatus 10. FIG. 9 shows a toilet apparatus 29 consisting of conventional toilet structure 30 and user-operated seat uplift apparatus 10. FIG. 10 shows a wheel chair apparatus 31 consisting of back support member 32, user-operated seat uplift apparatus 10, and wheel assembly 33.

While it will be apparent that the preferred embodiment of the invention herein disclosed is well calculated to fulfill the objects above stated, it will be appreciated that the invention is susceptible to modification, variation, and change without departing from the proper scope or fair meaning of the subjoined claims.

I claim:

1. A seat lift apparatus, comprising:

a frame;

a seat mounted to a first member which is slidably coupled to said frame to allow movement of said seat in a substantially vertical direction with respect to said frame;

a hand engagement handle mounted to a second member for receiving downward force from the user, the second member also being slidably coupled to said frame to move independently of said first member in a substantially vertical direction with respect to said frame;

a power translating mechanism operatively connected between said first and second members for translating the downward force applied by the user on said hand engagement handle into an upward force on the seat thereby assisting the user into a raised position.

2. The seat lift apparatus of claim 1, the first member comprising:

at least one elongated seat support member connected to and extending downwardly from said seat and slidably coupled to said frame, said seat support member being connected to said power translating mechanism.

3. The seat lift apparatus of claim 2, the frame comprising at least one guide adapted to receive said seat support member and slidably guide said member in a substantially vertical direction with respect to said frame.

4. The seat lift apparatus of claim 3, the guide including a vertically extending tube section to contain and slidably guide said elongated seat support member along a portion of its length.

5. The seat lift apparatus of claim 1, the seat being substantially planar.

6. The seat lift apparatus of claim 1, the second member comprising:

at least one elongated handle support member connected to and extending downwardly from said hand engagement handle and slidably coupled to said frame, said handle support member being connected to said power translating mechanism.

7. The seat lift apparatus of claim 6, said frame comprising at least one guide adapted to receive said handle support member and guide said member in a substantially vertical direction with respect to said frame.

8. The seat lift apparatus of claim 7, said guide including a vertically extending tube section to contain and guide said elongated handle support member along a portion of its length.

9. The seat lift apparatus of claim 1, said power translating mechanism comprising:

a pulley system including a plurality of pulley wheels and at least one tether in contact with and slidably moving on said pulley wheels, said first and second members operatively connected with said tether so that a downward force on said hand engagement handle moves the tether around the pulley wheels and forces said seat upwardly.

10. The seat lift apparatus of claim 1, the power translating mechanism comprising:

at least one lever pivotally mounted on said frame, said first member operatively connected with one end of said lever and said second member operatively connected with the other end of said lever so that a downward force on said hand engagement handle forces said seat upwardly.

11. A seat lift apparatus, comprising:

a frame;

a seat connected to at least one elongated seat support member which extends downwardly from said seat, said seat support member being slidably coupled to said frame to allow movement of said seat in a substantially vertical direction with respect to said frame;

a hand engagement handle for receiving downward force from the user, said handle connected to at least one elongated handle support member which extends downwardly from said handle, said handle support member slidably coupled to said frame to move independently of said seat support member in a substantially vertical direction with respect to said frame;

a power translating mechanism operatively connected between said seat support member and said handle support member for translating the downward force applied by the user on said hand engagement handle into an upward force on the seat thereby assisting the user into a raised position.

12. The seat lift apparatus of claim 11, the seat being substantially planar.

13. The seat lift apparatus of claim 11, the frame comprising a plurality of guides, said guides adapted to receive one of said handle support member and said seat support member, said guides slidably guiding said support members in a substantially vertical direction with respect to said frame.

14. The seat lift apparatus of claim 13, wherein at least one guide member includes a vertically extending tube section to contain and slidably guide a support member along a portion of its length.

15. The seat lift apparatus of claim 11, said frame having at least four sides and four corners, the apparatus further comprising:

at least four seat support members connected to and extending downwardly from said seat, a seat support member slidably coupled to said frame proximate each of the four corners of said frame to allow movement of said seat in a substantially vertical direction;

at least two hand engagement handles, a handle located proximate each of two sides of said frame;

at least four handle support members connected to and extending downwardly from said hand engagement handles, a handle support member slidably coupled to said frame proximate each of the four corners of said frame and proximate a respective seat support member to allow movement of said handles in a substantially vertical direction.

16. The seat lift apparatus of claim 15, the frame comprising a plurality of guides adapted to receive said support members, at least two guides located proximate each frame corder for receiving said seat support member and said grip support member at the corner to slidably guide said support members in a substantially vertical direction.

17. The seat lift apparatus of claim 16, wherein at least one guide member includes a vertically extending tube section to contain and slidably guide a support member along a portion of its length.

18. The seat lift apparatus of claim 11, the power translating mechanism comprising:

a pulley system including a plurality of pulley wheels and at least one tether in contact with and slidably moving on said pulley wheels, said seat support member and said handle support member operatively connected with said tether so that a downward force on said hand engagement handle moves the tether around the pulley wheels and forces said seat vertically upwardly.

19. The seat lift apparatus of claim 11, the power translating mechanism comprising:

at least one lever pivotally mounted on said frame, said seat support member operatively connected with one end of said lever and said handle support member operatively connected with the other end of said lever so that a downward force on said hand engagement handle forces said seat upwardly.

20. A seat lift apparatus, comprising:

a generally rectangular frame having four opposing corners and four opposing sides;

a generally rectangular planar seat mounted above said frame;

four seat support members, a seat support member connected to and extending downwardly from said seat proximate each of the opposing corners of said seat, said seat support members being slidably coupled to said frame to allow movement of said seat in a substantially vertical direction with respect to said frame.

two elongated hand engagement handles mounted on opposing sides of said frame for receiving downward force from the user;

four handles support members, a handle support member connected to and extending downwardly from said handle proximate each end of said elongated handle, said handle support members each being slidably coupled to said frame proximate a corner of said frame to move independently of said seat support members in a substantially vertical direction with respect to said frame;

power translating mechanism operatively connected between said handle support members and said seat support members for translating the downward force applied by the user on said handle into an upward force on the seat thereby assisting the user into a raised position.

21. The seat lift apparatus of claim 20, said frame comprising a pair of guides proximate each of the four opposing frame corners, said guides adapted to receive the seat support member and handle support member at each frame corner for slidably guiding said support members in a substantially vertical direction with respect to said frame.

22. The seat lift apparatus of claim 21, each guide member including a vertically extending tube section to contain and slidably guide each support member along a portion of its length.

23. The seat lift apparatus of claim 20, the power translating mechanism comprising:

a pulley system including a plurality of pulley wheels and at least one tether in contact with and slidably moving on said pulley wheels, said handle support members and said seat support members operatively connected with said tether so that a downward force on said hand engagement handles moves the tether around the pulley wheels and forces said seat upwardly.

24. The seat lift apparatus of claim 23, the pulley system further comprising:

a first pulley wheel rotatably mounted to the end of each handle support member opposite the grip rail, a second pulley wheel mounted on said frame to one side of each said handle support member at each corner of the frame;

a third pulley wheel mounted on said frame to an opposite side of each said handle support member at each corner of the frame, said handle support member at a corner extending between said second and third pulley wheel of the respective corner;

a tether operatively connecting two seat support members located on one side of said frame, and a tether operatively connecting the two seat support members located on the other side of said frame each tether extending between the seat support members located on the same side of the frame by travelling over the second and third pulley wheels and under the first pulley wheel associated with each handle support member;

whereby when the handles are forced downward, the handle support members push the tethers vertically downward around the second and third pulley wheels causing the tether to pull upward on the seat support members moving said seat upwardly.

25. The seat lift apparatus of claim 20, said power translating mechanism comprising:

a plurality of elongated levers pivotally mounted to said frame, proximate the opposing corners of said frame;

a handle support member and a seat support member connected to opposing ends of each said lever so that when the hand engagement handles are forced downward, the levers pivot and force the seat upwardly.

26. The seat lift apparatus of claim 25, each elongated lever having a pivot point on said frame displaced from the middle of the lever to produce a force multiplication between the movement of said hand engagement handles and the movement of said seat.

27. The seat lift apparatus of claim 26, said pivot point being closer to the lever end connected to said seat support member than to the lever end connected to said handle support member so that the downward force on said handles is multiplied for a greater upward force on said seat.

28. The seat lift apparatus of claim 27, said pivot point being displaced so as to produce a 2 to 1 force multiplication between the downward force on said handles and the upward force on said seat.

29. The seat lift apparatus of claim 20 in combination with a wheel chair structure.

30. The seat lift apparatus of claim 20 in combination with a toilet structure.

* * * * *